US009095239B2

(12) United States Patent
Laera

(10) Patent No.: US 9,095,239 B2
(45) Date of Patent: Aug. 4, 2015

(54) DRAIN INSERT

(76) Inventor: Vito Laera, Fort Lauderdale, FL (US)

( * ) Notice: Subject to any disclaimer, the term of this patent is extended or adjusted under 35 U.S.C. 154(b) by 655 days.

(21) Appl. No.: 12/853,396

(22) Filed: Aug. 10, 2010

(65) Prior Publication Data

US 2012/0036624 A1 Feb. 16, 2012

(51) Int. Cl.

| | |
|---|---|
| ***A47K 1/14*** | (2006.01) |
| ***E03C 1/26*** | (2006.01) |
| ***E03C 1/23*** | (2006.01) |

(52) U.S. Cl.

CPC ..... *A47K 1/14* (2013.01); *E03C 1/2306* (2013.01); *E03C 2001/2317* (2013.01)

(58) Field of Classification Search

USPC ..... 4/286–295

See application file for complete search history.

(56) References Cited

U.S. PATENT DOCUMENTS

| | | | | |
|---|---|---|---|---|
| 2,021,410 | A | 11/1935 | Foose | |
| 2,095,241 | A * | 10/1937 | Cox | 4/638 |
| 3,949,433 | A | 4/1976 | Liou | |
| 6,387,261 | B1 * | 5/2002 | Mojena | 210/315 |
| 2004/0226085 | A1 * | 11/2004 | Wang | 4/295 |
| 2011/0154563 | A1 * | 6/2011 | Ball et al. | 4/293 |

* cited by examiner

*Primary Examiner* — Janie Christiansen

(57) ABSTRACT

A pop-up drain plug insert comprising: a base formed for secure placement within a drain bowl in a sink which includes a bottom having a solid center and a plurality of apertures, a side emanating upwardly from the perimeter of the bottom, a flange emanating outwardly from the side, a gasket operatively associated with the side and the flange and a wall emanating upwardly near the center of the bottom to form a cup, the wall being substantially parallel to the side; a stopper formed for secure placement within the base which includes a top, a stem having a spring mechanism which permits the extension and retraction of the stem emanating downwardly from the top, a gasket surrounding the stem and being operatively associated with the top, wherein the stem being operatively associated with the cup in order to raise and lower the stopper from the base in order to permit or restrict the flow of liquids through the base.

8 Claims, 5 Drawing Sheets

DRAIN INSERT

FIELD OF THE INVENTION

The invention relates to pop-up drains for use in sinks.

BACKGROUND OF THE INVENTION

Drain plugs configured for use in sinks are known. The combination of a strainer and a loose drain plug is also known. Pop-up drain assemblies for sinks in the prior art commonly use a lever actuated means to raise and lower the drain stopper within the drain bowl. However, unlike bathroom sinks, kitchen sinks are not configured to accept the lever assembly. The loose drain plug also poses several problems in that it may be easily lost among the dirty dishes and organic food pieces which often occupy a sink during meal preparation.

Permanently fixed, pop-up drain plugs make the addition of a removable strainer inconvenient at best and impossible at worst. Many consumers dread dealing with clogged plumbing pipes resulting from solid materials collecting within a pipe and restricting or preventing the flow of liquid through the drain pipe. At the same time, consumers desire a convenient way to prevent the flow of solids and/or liquids through a sink drain. Hence, there exists an unsatisfied need for a pop-up drain plug insert which may be either removed from a drain bowl completely or remain within the drain bowl and be operated by a simple push-down pop-up mechanism.

SUMMARY OF THE INVENTION

A pop-up drain plug insert comprising: a base formed for secure placement within a drain bowl in a sink which includes a bottom having a solid center and a plurality of apertures, a side emanating upwardly from the perimeter of the bottom, a flange emanating outwardly from the side, a gasket operatively associated with the side and the flange and a wall emanating upwardly near the center of the bottom to form a cup, the wall being substantially parallel to the side; a stopper formed for secure placement within the base which includes a top, a stem having a spring mechanism which permits the extension and retraction of the stem emanating downwardly from the top, a gasket surrounding the stem and being operatively associated with the top, wherein the stem being operatively associated with the cup in order to raise and lower the stopper from the base in order to permit or restrict the flow of liquids through the base.

BRIEF DESCRIPTION OF THE DRAWINGS

For the purpose of illustrating the invention, there is shown in the figures a form that is presently preferred; it being understood, however, that this invention is not limited to the precise arrangements and instrumentalities shown.

DETAILED DESCRIPTION

Pop-up drain plug insert 10, as used herein, refers to a device comprising a base 20 and a stopper 40. A pop-up drain plug insert 10 may further comprise a strainer 72.

Figure 2:
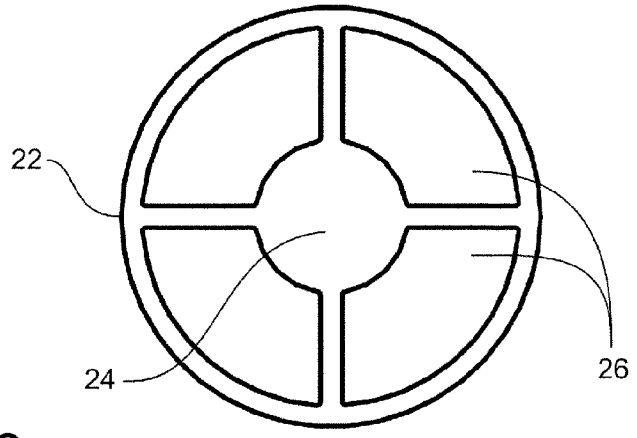
FIG. 2 illustrates the bottom of a base of a pop-up drain plug insert.
Figure 3:
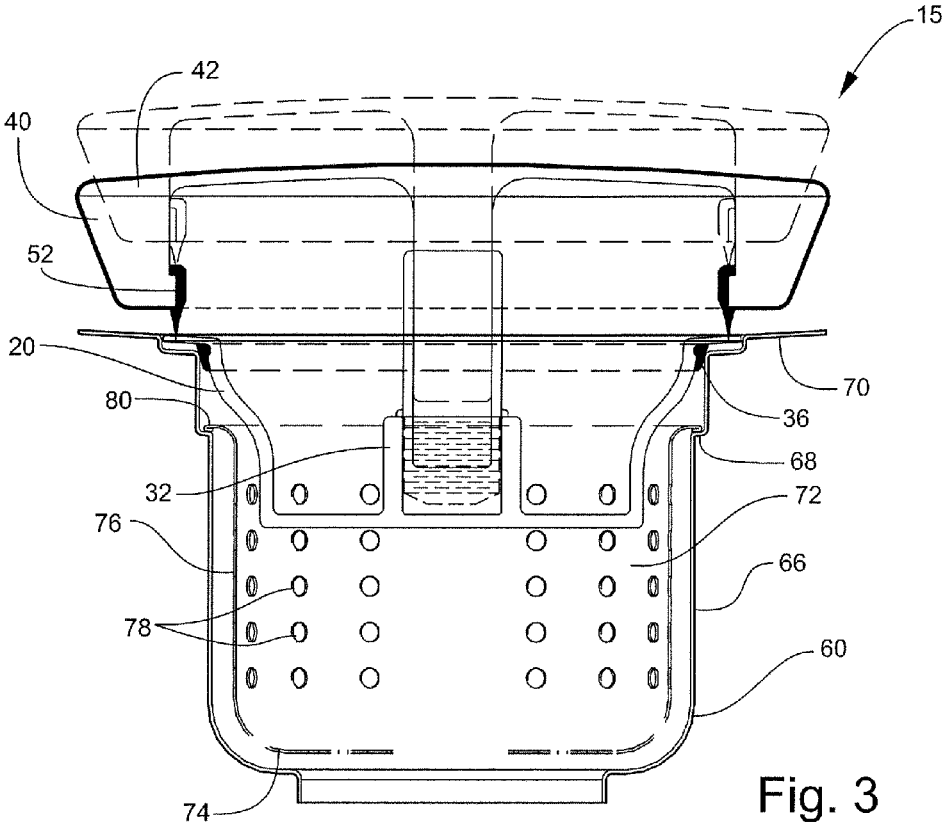
FIG. 3 illustrates a cross section of a pop-up drain assembly depicting the stopper in both an open and closed position.
Figure 5:
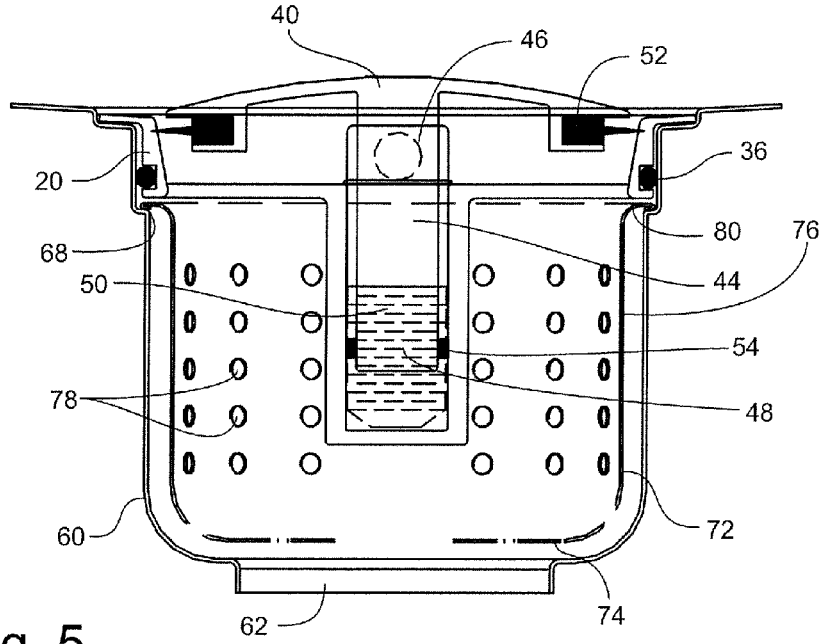
FIG. 5 illustrates a cross section of a pop-up drain plug insert with a strainer.
Figure 6:
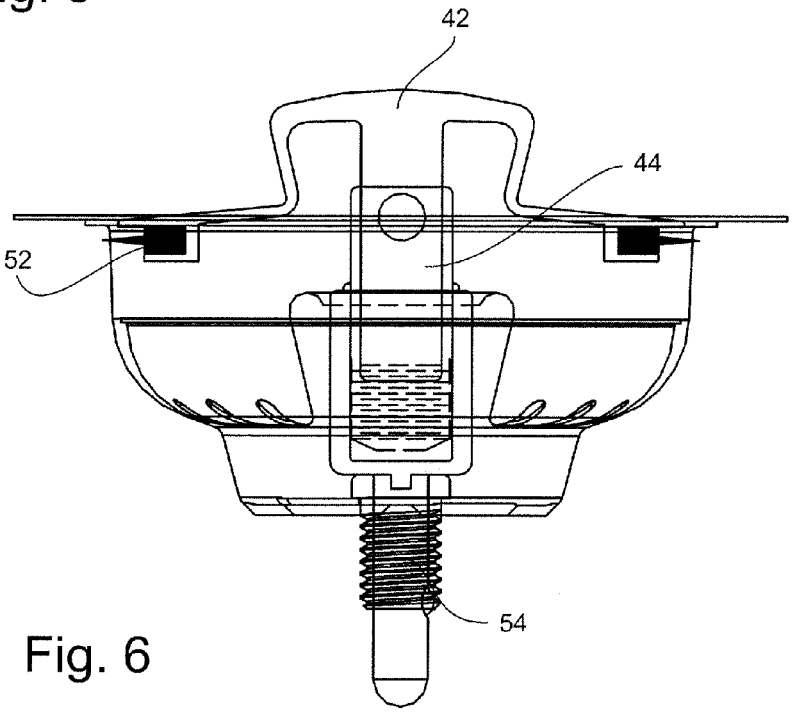
FIG. 6 illustrates a cross section of a pop-up drain plug insert.

Base 20, as used herein, refers to a device which is designed to fit securely within a drain bowl 60. In other words, a base 20 may be formed for secure placement within a drain bowl 60 in a sink. Looking to FIGS. 1 and 2, the base 20 includes a bottom 22 having a solid center 24 and a plurality of apertures 26. The apertures 26 allow for the passage of solids and/or liquids through the base 20 and into a drain bowl 60 (FIGS. 3 and 5). The base 20 also includes a side 28 emanating upwardly from the perimeter of the bottom 22 of the base 20. The side 28 may have an inner surface and an outer surface wherein the outer surface of the side may come into contact with the drain bowl 60. The base 20 may also include a shoulder 38 along the inner surface of the side 28. In one embodiment of the present invention, the shoulder 38 is operatively associated with the stopper 40, the gasket of the stopper 52 or a combination thereof. In another embodiment of the present invention, the shoulder 38 is designed to engage the top or flange of an item which may be inserted into the base such as a stopper 40, a gasket or a pop-up drain plug insert 10.

The base 20 may also include a flange 30 emanating outwardly from the top of the side 28. The flange 30 may be designed to engage the shoulder 68 or the flange 70 of a drain bowl. The base 20 may also include a wall 32 emanating upwardly around the solid center 24 of the base bottom 22 to form a cup 34. The wall 32 of the cup 34 may be substantially parallel to the side 28 of the base. In one embodiment of the present invention, the base 20 may also include a gasket 36 which is operatively associated with the side 28 and/or the flange 30 of the base 20. The gasket 36 is operatively associated with the base 20 and the drain bowl 60. The gasket 36 allows for a complete or substantially complete seal which prevents the flow of liquid between a base 20 and a drain bowl 60. (See FIGS. 7, 8 and 9). In one embodiment of the present invention, the base 20 may be removable. In one embodiment, a base 20 is a device which is designed to fit securely within a strainer 72.

Pop-up drain assembly 15, as used herein, refers to a device comprising a drain bowl 60, a base 20 and a stopper 40. A pop-up drain assembly 15 may further comprise a strainer 72.

Figure 4:
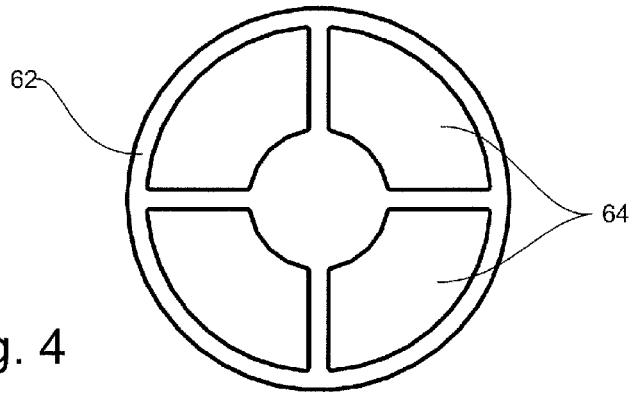
FIG. 4 illustrates the bottom of a base of a pop-up drain plug insert.

Drain bowl 60, as used herein, refers to a device formed for secure placement within a drain opening of a sink. In this case, secure placement means that substantially no liquid or solid material is permitted to flow through the connection between the drain bowl 60 and the drain opening, thus causing all liquid and solid material to flow through the drain bowl and into a disposal and/or drain pipe. Looking to FIGS. 3, 4 and 5, the drain bowl 60 includes a bottom 62 having a center portion and a plurality of apertures 64. The center portion may be either solid or open. The drain bowl 60 also includes a side 66 emanating upwardly from the perimeter of the bottom 62 of the drain bowl. The side 66 may have an inner surface and an outer surface. The drain bowl 60 may also include a shoulder 68 along the inner surface of the side. The shoulder 68 is designed to engage the top or flange of an item which may be inserted into the drain bowl such as a strainer 72, a pop-up drain plug insert 10, a stopper 40, a gasket, a combination thereof or any other item known in the art. The drain bowl 60 may also include a flange 70 emanating outwardly from the top of the side 66. The drain bowl flange 70 is designed to securely engage the drain opening in a sink.

Figure 10:
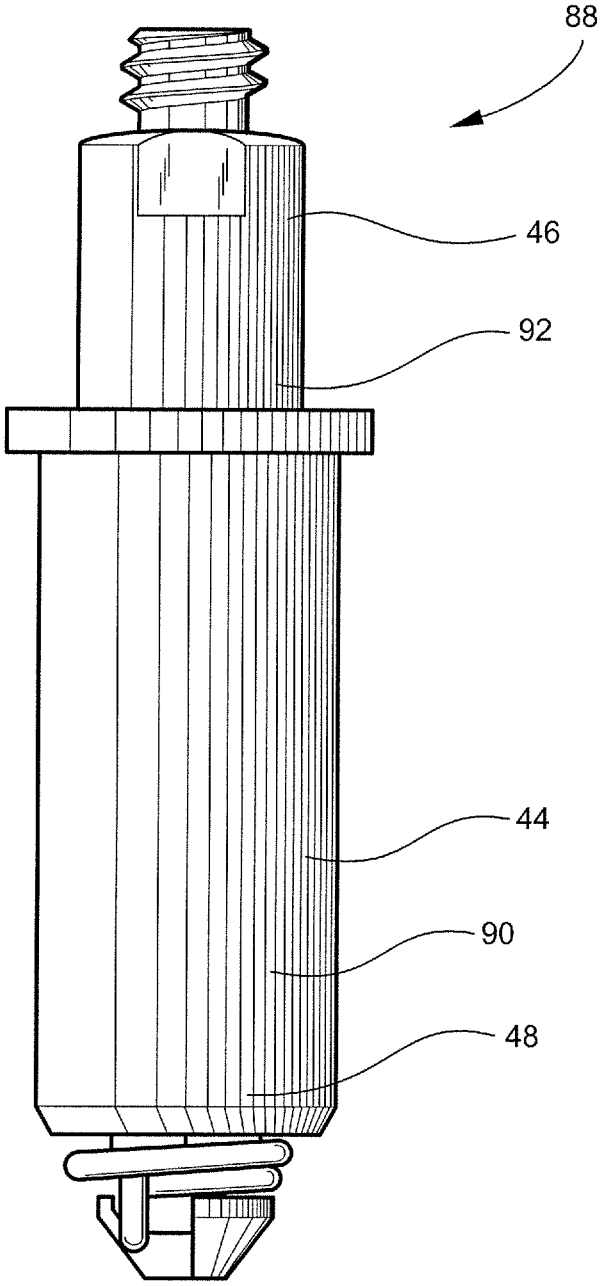
FIG. 10 illustrates one embodiment of the stem of a pop-up drain plug insert.

Stopper 40, as used herein, refers to a device which is formed to allow for secure placement within a base 20. Looking to FIGS. 1, 3 and 4 we see illustrated one embodiment of the stopper 40 which may be comprised of a top 42 which may be any shape so long as it is capable of permitting or restricting the flow of liquids and/or solids through a base 20. Beneath the top 42 is a stem 44 which emanates downwardly from the top. The stem 44 may have a spring mechanism 50 which permits the extension and retraction of the stem 44 and/or the top 42 of the stopper 40. Looking to the embodiment illustrated in FIG. 5, the stem 44 may have a proximal end 46 which is attached to the top and a distal end 48 which is designed to engage with the cup 34 of the base 20. (See also FIG. 10). The stem 44 may be operatively associated with the cup 34 of the base 20 in order to raise and lower the stopper 40 from the base 20 in order to permit or restrict the flow of liquids and/or solids through the base 20 and the drain bowl 60. In one embodiment of the present invention, a push-down pop-up mechanism is used as all or part of a stem in order to raise and lower the top 42 of a stopper.

A push-down pop-up mechanism 88 is a mechanical device which is operated by a user. (See one embodiment in FIG. 10). The push-down pop-up mechanism 88 may be in an extended position or a retracted position. The push-down pop-up mechanism 88 may include an outer body 90 and an inner body 92 which is designed to fit inside the outer body and is telescopically engaged to the outer body 90. Contained within the outer body 90 is a spring (not shown) which may be compressed by the inner body 92. Also contained within the outer body 90 is a locking mechanism (not shown). The push-down pop-up mechanism 88 can be shortened from its extended position by pushing down on either the inner body 92 or the outer body 90 which causes the inner body to slide telescopically within the outer body and compress the spring which is operatively associated with the push-down pop-up mechanism 88. When the spring is sufficiently compressed, the locking mechanism engages and locks the inner body and the outer body together in a retracted position. In order to disengage the locking mechanism and return the push-down pop-up mechanism 88 to its extended position, a user pushes down on either the inner body 92 or the outer body 90 in order to disengage the locking mechanism and decompress the spring. Examples of embodiments of push-down pop-up mechanisms 88 which may be used are Model M16X1.5 and JC-103 (without the threaded portion on the distal end) which are supplied by Tiazhou Jingchuan Sanitary Wares Co., Ltd. Of Zhijiang, China (Mainland).

In one embodiment of the present invention, the stem 44 is a push-down pop-up mechanism 88 which is attached to a top 42 of a stopper 40 at its proximal end 46. The distal end 48 is operatively associated with a cup 34 of a base 20. The distal end of the stem 44 is inserted into the cup 34. Beginning with the stem 44 in an extended position, a user pushes down on the top 42 of a stopper 40, with enough force to compress the spring within the push-down pop-up mechanism 88 and engage a locking mechanism and hold the stem 44 in a retracted position.

The stopper 40 may also include a gasket 52 which surrounds the stem 44 and is operatively associated with the top 42 of the stopper and the base 20. When the stopper is pushed down and the stem 44 is the retracted position, the gasket 52 is compressed between the top 42 of the stopper and the base 20 and thus allows for a complete or substantially complete seal which prevents the flow of liquid through the base 20 and the drain bowl 60. In one embodiment of the present invention, the stem 44 may have a proximal end 46 attached to a top 42 and a distal end 48 further comprising a fastening means 54 which is operatively associated with a cup 34 of a base 20.

Fastening means 54, as used herein, refers to a device which temporarily joins or affixes two or more objects together. Examples of fasteners include, but are not limited to, a gasket, a retaining ring, a threaded fastener, a pin, an adhesive, a clip, a snap, a tie, a hook-and-loop fastener, or a combination thereof. In one embodiment of the present invention, a fastening means 54 is used to fasten a stem 44 of a stopper to a cup 34 of a base. In another embodiment of the present invention, both the cup 34 and the distal end 48 of the step are machine threaded.

Figure 1:
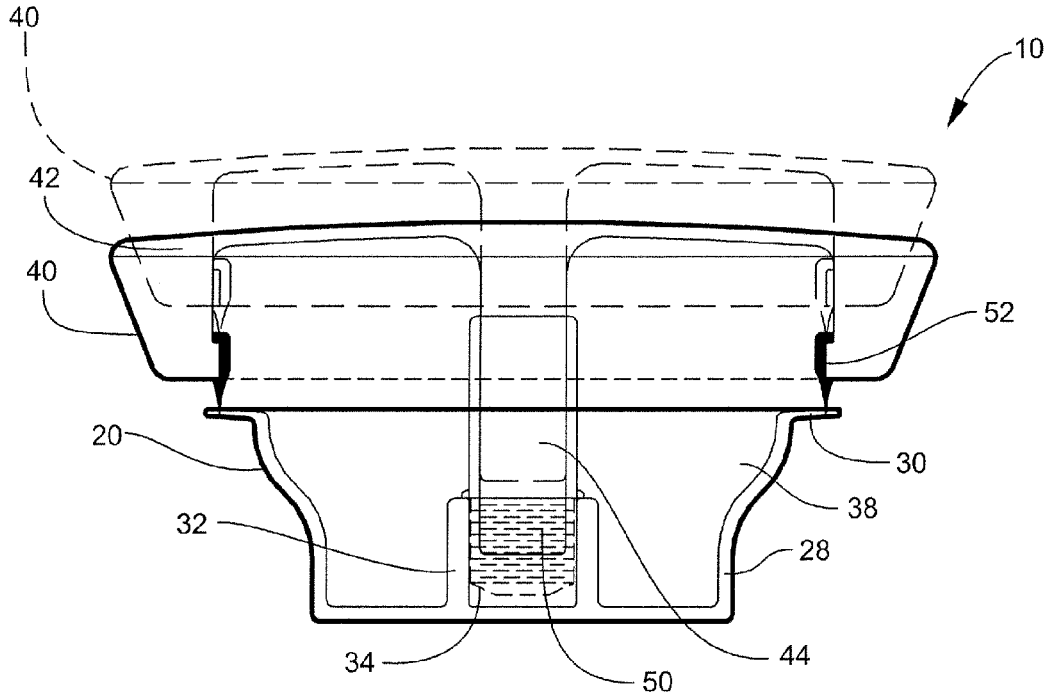
FIG. 1 illustrates a cross section of a pop-up drain plug insert depicting the stopper in both an open and closed position.

Gasket, as used herein, refers to a mechanical seal that fills the space between two mating surfaces in order to prevent leakage from or into the joined objects while under compression. A gasket may be comprised of any material known in the art which includes, but is not limited to, paper, rubber, silicone, metal, cork, felt, neoprene, nitrile rubber, fiberglass, plastic polymer or a combination thereof. Possible embodiments of gaskets are illustrated in FIGS. 1, 3 and 5-9 in the instant invention. FIG. 3 illustrates one embodiment of a base gasket 36 operatively associated with a base 20 and a drain bowl 60. FIGS. 1 and 3 illustrate another embodiment of a stopper gasket 52 operatively associated with a stopper 40 and a base 20. FIG. 5 illustrates one embodiment of the current invention wherein a base gasket 36 is operatively associated with a base 20 and a drain bowl 60. FIG. 5 also illustrates one embodiment of the current invention wherein a stopper gasket 52 is operatively associated with a stopper 40 and a base 20.

Strainer 72, as used herein, refers to a device which is designed for secure placement within a drain bowl 60. A strainer 72 is a device used to separate solid material from liquid material within a sink. In the instant application, a strainer 72 may be used to prevent solid waste from traveling through a drain bowl 60, a base 20, a drain opening, or a combination thereof. To fit securely means that a limited amount of liquid is permitted to flow between the edge of the strainer 72 and the drain bowl 60. FIGS. 3 and 5 illustrate two embodiments of a strainer 72 which may be comprised of a bottom 74, a side 76 emanating upwardly from the perimeter of said bottom. The side 76 may include a plurality of apertures 78. The strainer 72 may also include a flange 80 emanating outwardly from the side 76. In one embodiment of the present invention, the flange 80 is designed to engage the shoulder 68 of a drain bowl. In another embodiment, the strainer 72 is removable.

Figures 7, 8, 9:
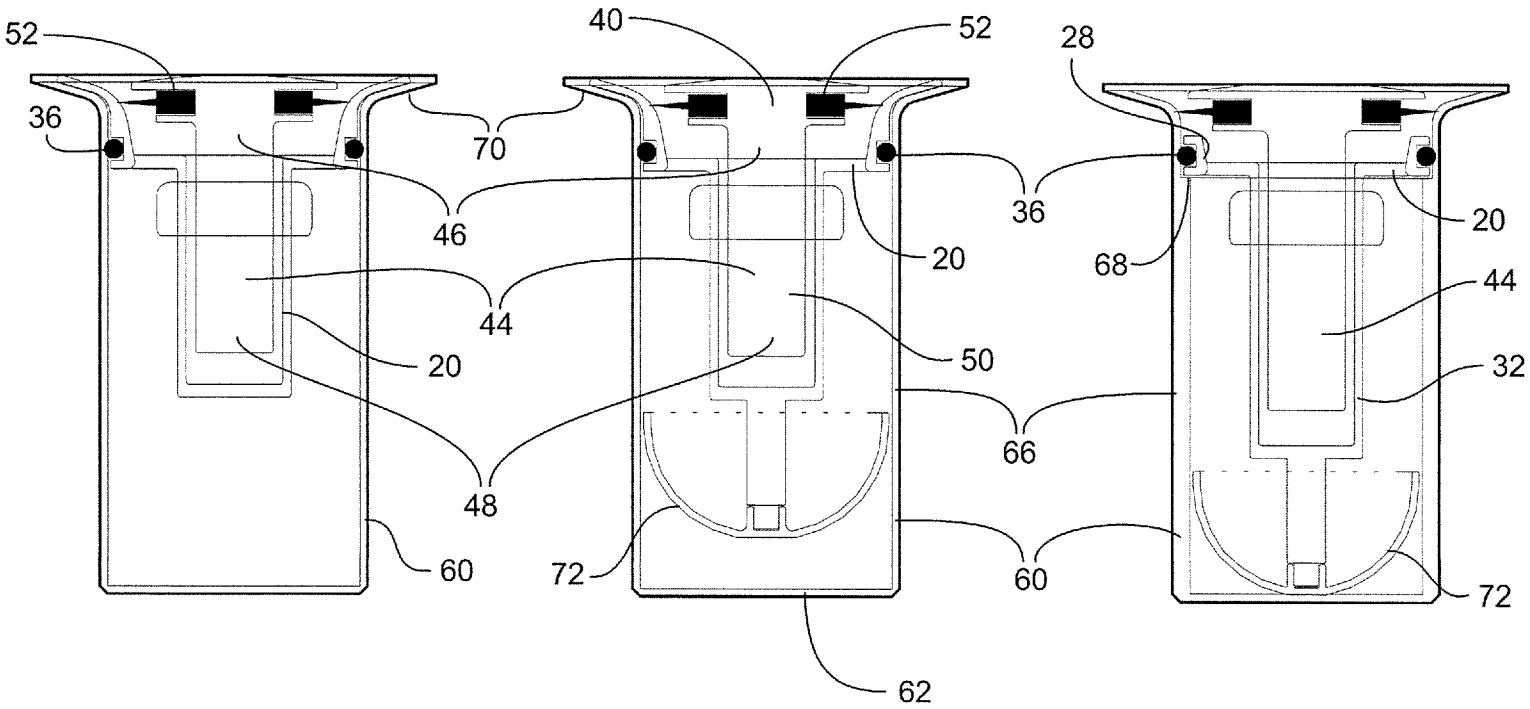
FIG. 7 illustrates a cross section of a pop-up drain plug insert.
FIG. 8 illustrates a cross section of a pop-up drain plug insert and a strainer.
FIG. 9 illustrates a cross section of a pop-up drain plug insert and a strainer.

In one embodiment of the present invention, the base 20 of the pop-up drain plug insert is permanently seated within a drain bowl 60. In another embodiment of the present invention, the base 20 of the pop-up drain plug insert may be removed and reinserted within a drain bowl 60 whenever a user desires. FIG. 7 illustrates one embodiment of the present invention wherein a base 20 is secured to a drain bowl 60 utilizing a gasket 36. FIG. 7 also illustrates the relationship between the stopper gasket 52, the top 42 and the base 20 wherein the gasket 52 is compressed between the surfaces of the top 42 and the base 20. FIGS. 8 and 9 each illustrate another embodiment of the present invention wherein a base 20 is secured to a drain bowl 60 utilizing a gasket 36. FIGS. 8 and 9 also incorporate the use of a strainer 72. Additionally, FIGS. 8 and 9 illustrate different base 20 configurations.

The invention claimed is:

1. A pop-up drain assembly consisting of:

a drain bowl formed for secure placement within the drain opening of a sink;

said drain bowl having a bottom with a plurality of apertures, a side emanating upwardly from the perimeter of said bottom, a shoulder along the surface of said side, and a flange emanating outwardly from said side;

a single strainer designed to fit within said drain bowl;

said strainer having a bottom, a side emanating upwardly from the perimeter of said bottom and a flange emanating outwardly from said side;

wherein the flange of said strainer is designed to engage the shoulder of said drain bowl;

wherein said strainer has a plurality of apertures along both the bottom and sides to permit the passage of liquids while retaining solids;

a base formed for secure placement within said strainer;

said base having a bottom with a solid center and a plurality of apertures, a side emanating upwardly from the perimeter of said bottom, a flange emanating outwardly from the side and a wall emanating upwardly near the center of the bottom to form a cup, said wall being substantially parallel to said side;

a stopper formed for secure placement within said base comprising:

a top;

a stem emanating downwardly from said top;

said stem having a spring mechanism which permits the extension and retraction of said stem;

said stem having a proximal end being attached to said top and a distal end further comprising a fastening means attached to said distal end and being operatively associated with said cup;

a gasket surrounding said stem and being operatively associated with said top and said base;

wherein said stem being operatively associated with said cup in order to raise and lower said stopper from said base in order to permit or restrict the flow of liquids and/or solids through said base.

2. The pop-up drain assembly of claim 1 wherein said base being removable.

3. The pop-up drain assembly of claim 1 wherein said strainer being removable.

4. The pop-up drain assembly of claim 1 wherein said fastening means being selected from the group comprising: a gasket, a retaining ring, a threaded fastener, a pin, an adhesive, a clip, a snap, a tie, a hook-and-loop fastener, or a combination thereof.

5. The pop-up drain assembly of claim 1 wherein said cup being machine threaded.

6. The pop-up drain assembly of claim 1 wherein said stem being a push-down, pop-up mechanism.

7. The pop-up drain assembly of claim 1, wherein said base further comprising a shoulder along the surface of the side;

said shoulder being operatively associated with the stopper, the gasket of the stopper, or a combination thereof.

8. The pop-up drain assembly of claim 1, wherein said base further comprising a gasket operatively associated with said side and said flange;

said gasket being operatively associated with the base and the drain bowl in a sink.

* * * * *